United States Patent [19]

Kolkmann

[11] 4,353,380

[45] Oct. 12, 1982

[54] HAIR CURLER

[76] Inventor: Ingeborg Kolkmann, Hofaue 53a, 5600 Wuppertal 1, Fed. Rep. of Germany

[21] Appl. No.: 252,723

[22] Filed: Apr. 10, 1981

[30] Foreign Application Priority Data

Apr. 28, 1980 [DE] Fed. Rep. of Germany ... 8011582[U]
Jun. 20, 1980 [DE] Fed. Rep. of Germany ... 8016346[U]

[51] Int. Cl.[3] ..... A45D 2/00
[52] U.S. Cl. ..... 132/40
[58] Field of Search ..... 132/40, 39, 341 R, 42

[56] References Cited

U.S. PATENT DOCUMENTS 2,720,207 10/1955 Burtnett ..... 132/43 R
2,889,834 6/1959 Anderson et al. ..... 132/43 R X
4,022,225 5/1977 Kauffman ..... 132/43 R

*Primary Examiner*—G. E. McNeill
*Attorney, Agent, or Firm*—Sughrue, Mion, Zinn, Macpeak and Seas

[57] ABSTRACT

A hair curler includes a flexible central lattice element 2 flanked by hinged wing elements 3, 4 and having a flattened coil spring 5 mounted thereon under tension, thus tending to roll up the curler. The curler is held open in a first embodiment by a segmented strip 6 mounted on a wing element and only rollable in one direction, whereby it blocks rolling when the wing element is folded out and enables it when the wing element is folded over the central element. Rolling is prevented in a second embodiment by angle springs 9 and/or corner bands 10 connected at the hinge points of cross bars 8 extending across the central and wing elements, to thus hold the opened wing elements perpendicular to the main element.

14 Claims, 7 Drawing Figures

HAIR CURLER

BACKGROUND OF THE INVENTION

This invention relates to a hair curler having a flexible winding member provided with openings, and an associated elastic spring which can be released when hair is to be rolled therein.

A hair curler having a tubular winding element in which a spring can be fixed in a tensed condition, and released to allow movement of the winding element as hair is curled thereon is taught in U.S. Pat. No. 3,454,016. This type of tubular hair curler is relatively expensive to manufacture and difficult to use.

SUMMARY OF THE INVENTION

An object of the invention is to provide a simple spring-type hair curler which is economical to manufacture and easy to use. This object is achieved by a hair curler having a flat main curler element and at least one flat, lateral wing element which can be folded against the main element. A coil spring is mounted on the main element in its tensed or uncoiled condition, and locking means are provided to prevent the curler from rolling up when the spring is under tension.

In a first embodiment of the invention the locking means comprises a longitudinal segmented strip mounted on a blocking wing element, which can only be rolled or coiled in one direction. In use a strand of hair is laid on the main element when the wing element is open. The wing element is thereafter closed which cancels the blocking effect whereby the curler rolls up automatically with the strand of hair under the influence of the spring.

In a second embodiment cross ribs are provided at least on the ends of the main and wing elements, and either angular spring or flexible band holding elements are provided to retain the wing element in an open, stable position approximately perpendicular to the main element to prevent the curler from rolling up. In use a strand of hair is laid on the main element when the wing element is open to its perpendicular position, and the wing element is then closed onto the main element. This cancels the blocking effect of the perpendicular wing element, and under the influence of the spring the curler together with the hair strand is automatically rolled up.

It is advantageous to provide two foldble wing elements hinged to opposite sides of the main element, each wing element being about half as wide as the main element. Blocking elements can be provided on one or both of the wing elements. With hair curlers formed in this manner, during use both wing elements are closed onto the main element after placement of the hair strand.

The longitudinal blocking element in the first embodiment consists of an elongated strip of abutting segments mounted on a wing element. In the open position the lateral walls of the short segments abut each other and prevent the rolling of the winding element under the influence of the spring. After the wing element has been folded onto the main element the blocking effect is cancelled and the curler rolls up.

All of the curler components except the metal coil springs may be manufactured of plastic in an integral or unitary manner by injection molding. The blocking strip segments can be made by subsequent lateral cutting.

The main element and wing elements of the second embodiment are preferably made with longitudinal filaments of smaller cross section and lateral filaments of larger cross section to increase the stability of the winding element and facilitate its rolling up.

DETAILED DESCRIPTION OF THE PREFERRED EMBODIMENTS

Figure 1:
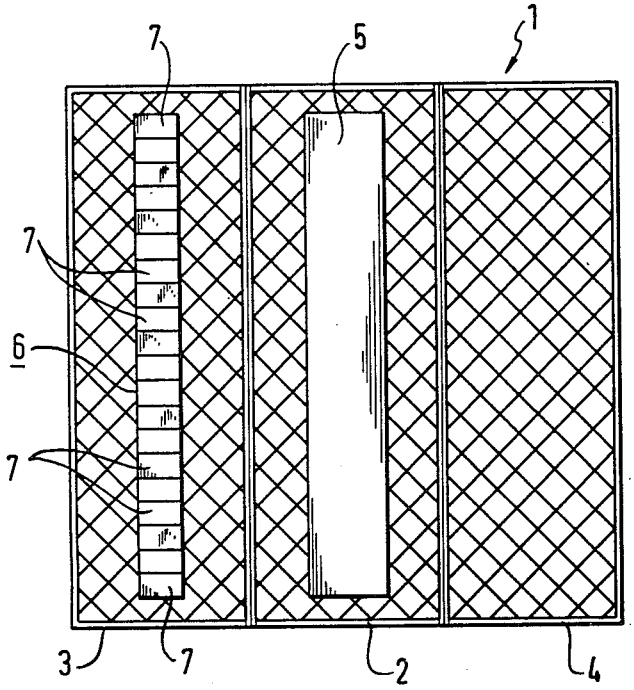
FIG. 1 is a top view of a first embodiment of a hair curler according to the present invention in an open position.
Figure 2:
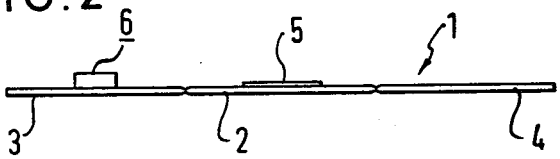
FIG. 2 is a front view of the hair curler according to FIG. 1.
Figure 3:
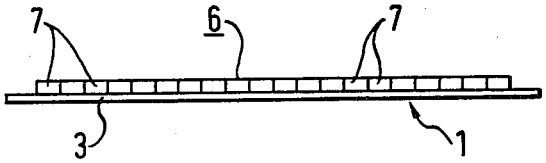
FIG. 3 is a side view of the hair curler according to FIG. 1.

The hair curler illustrated in FIGS. 1 through 3 includes a flexible planar winding member 1 in the form of a plastic lattice or screen, but can also be made from wire or textile fabric. The winding member 1 consists of a central element 2 and wing elements 3, 4 hinged on both sides thereof such that they can easily be folded onto the central element.

A planar coil spring 5, preferably made of metal, is mounted on the central element 2 such that in its uncoiled or flattened condition, as shown, it is under tension. The spring 5 can also be mounted on the underside of the central element, and it is preferably coated with plastic to protect the rolled up hair during drying.

An elongated blocking strip 6 is mounted on wing element 3 and consists of a plurality of abutting segments 7. The strip 6 is preferably made of plastic, and may be formed in one piece with the winding member 1.

In the open position of the hair curler the abutting segments 7 prevent the winding member 1 from rolling up under the effect of the spring 5. If the wing elements 3 and 4 are folded onto the central element, however, after a strand of hair has been laid thereon, the blocking effect of the strip segments 7 is eliminated and the widing member rolls up into a tight coil together with the hair held between the central element 2 and the closed wing elements 3 and 4. To release the hair curler the winding member is unrolled by hand and the wing elements 3 and 4 are folded outwardly. In so doing the blocking effect of the segments 7 is reinstated and the winding member remains in the flattened position shown in FIGS. 1 through 3.

The hair curler shown in FIGS. 4 through 7 includes a three-part winding member 1 in the form of a lattice made from longitudinal filaments 11 of smaller cross section and lateral filaments 12 of larger cross section. The winding member consists, as before, of a central element 2 and wing elements 3 and 4 hinged on both sides thereof such that they can easily be folded onto the central element. The width of the wing elements 3 and 4 is equal to half the width of the central element 2.

Figure 4:
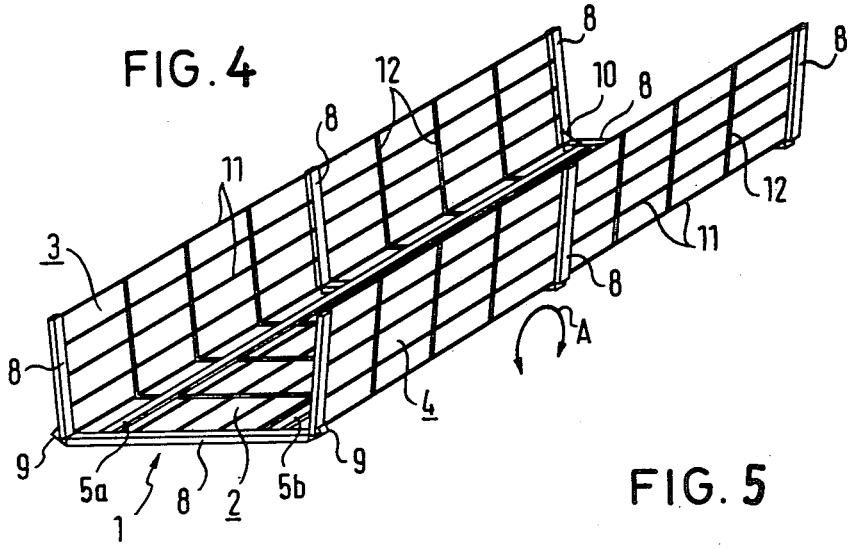
FIG. 4 is a perspective view of a second embodiment of a hair curler according to the invention with raised wing elements.

Narrow longitudinal coil springs **5*a*, 5*b*, preferably of metal, are mounted on the central element 2** along the sides thereof, and are under tension in the uncoiled condition shown in FIG. 4. The springs 5*a*, 5*b* can also be mounted on the underside of the central element, and they are preferably coated with plastic to protect the rolled up hair during drying.

Cross ribs 8 are mounted on both ends of the central and wing elements, as well as on the centers thereof. Holding elements are provided in the form of either angle springs 9 hinged to the outside of the cross ribs, or flexible bands 10 connected to the insides of the ribs near the hinge lines. These holding elements maintain the wing elements 3, 4 in a stable, open position basically perpendicular to the central element 2, whereat the wing elements prevent the winding member from rolling up under the influence of the springs 5*a*, 5*b*. The cross ribs 8 and the holding elements 9, 10 are preferably made of plastic, and may be formed in one piece with the winding member.

Figure 5:
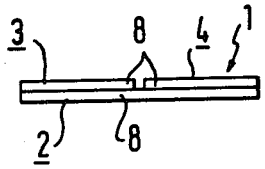
FIG. 5 is a front view of the hair curler of FIG. 4 with the wing elements closed onto the main element.
Figure 6:
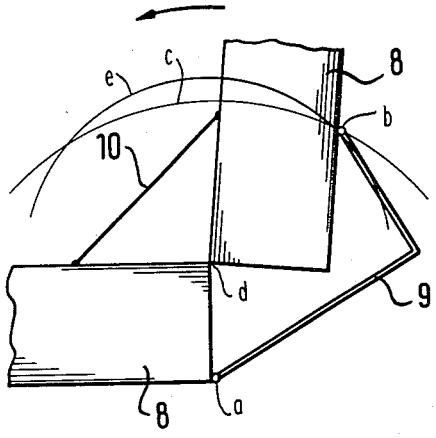
FIG. 6 is an enlarged partial front view of the hair curler of FIG. 4.
Figure 7:
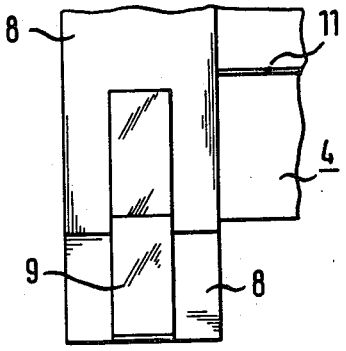
FIG. 7 is a partial side view of the detail of the hair curler shown in FIG. 6.

More specifically, each angle spring 9 always tends to assume a position whereat its two legs are perpendicular to each other. Referring to FIG. 6, spring 9 is hinged at points a and b to the other surfaces of cross rib 8. Since point b in free or unrestrained rotation would run along circular path c, while a point on rib 8 rotated about hinge point d would define a circular path e, the two intersections of these circular paths thus represent the stable positions of spring 9 whereat the wing element 4 is held in either the folded position of FIG. 5 or the open position of FIG. 6.

In the position of the hair curler shown in FIG. 4 the opened wing elements 3, 4 prevent the winding member 1 from rolling up under the influence of the springs 5*a*, 5*b* in the direction of double arrow A. When the wing elements are folded onto the central element 2 as shown in FIG. 5, however, their blocking effect is removed and the winding member rolls up together with any hair held between the central element and the closed wing elements.

To release the hair curler the winding member is manually unrolled and the wing elements are raised. This reinstates the blocking effect of the wing elements and the winding member remains in the position shown in FIG. 4.

What is claimed is:

1. A hair curler, comprising: a flexible winding member (1) having openings therein, a tensionable spring (5, 5*a*, 5*b*) associated with the winding member for rolling it into a coil when released, the winding member including a flat main element (2) and at least one flat lateral wing element (3, 4) hinged thereto and foldable thereon and thereover, the spring being mounted on the main element in a tensioned condition, and a longitudinal blocking strip (6) mounted on the wing element (3) and capable of being rolled up in only one direction for preventing the main element from rolling up under the influence of the spring when the wing element is folded out ot an open position substantially co-planar with the main element.

2. A hair curler, comprising: a flexible winding member (1) having openings therein, a tensionable spring (5, 5*a*, 5*b*) associated with the winding member for rolling it into a coil when released, the winding member including a flat main element (2) and at least one flat lateral wing element (3, 4) hinged thereto and foldable thereon and thereover, the spring being mounted on the main element in a tensioned condition, cross ribs (8) mounted on at least the opposite ends of the main element and a wing element, and holding elements (9, 10) for retaining the wing element in an approximate perpendicular position relative to the main element to thereby prevent the main element from rolling up under the influence of the spring.

3. Hair curler according to claims 1 or 2, wherein the winding member is made of plastic.

4. Hair curler according to claims 1 or 2, wherein the winding member is made of a textile fabric.

5. Hair curler according to claims 1 or 2, wherein the spring comprises at least one narrow metal band coil spring.

6. Hair curler according to claim 1, wherein the longitudinal blocking strip comprises a plurality of short strip segments (7) in abutment with each other on the opened wing element.

7. Hair curler according to claims 1 or 2, wherein two lateral wing elements which can be closed onto the main element are hinged to opposite sides of the main element.

8. Hair curler according to claim 5, wherein the spring is coated with plastic.

9. Hair curler according to claim 6, wherein the segments are formed in one piece with the wing element.

10. Hair curler according to claim 7, wherein the wing elements each having a width approximately equal to half the width of the main element.

11. Hair curler according to claim 2, wherein the holding elements (9) are angle spring elements hingedly connected to the outsides of the cross ribs of the main element and the wing element.

12. Hair curler according to claim 2, wherein the holding elements (10) are flexible bands connected to the insides of the cross ribs of the main element and the wing element.

13. Hair curler according to claims 11 or 12, wherein the cross ribs and the holding elements are formed in one piece with the main element and the wing element.

14. Hair curler according to claim 2, wherein the main element and the wing elements are constructed of longitudinal filaments (11) of smaller cross section and lateral filaments (12) of larger cross section.

* * * * *